United States Patent [19]

Cabo et al.

[11] 4,014,716

[45] Mar. 29, 1977

[54] WROUGHT BRASS ALLOY HAVING A LOW SPRING BACK COEFFICIENT AND SHAPE MEMORY EFFECT

[75] Inventors: Amado Cabo; Horace Pops, both of Pittsburgh, Pa.

[73] Assignee: Essex International, Inc., Fort Wayne, Ind.

[22] Filed: Sept. 20, 1974

[21] Appl. No.: 508,098

Related U.S. Application Data

[63] Continuation of Ser. No. 107,118, Jan. 18, 1971, abandoned.

[52] U.S. Cl. ..... 148/11.5 C

[51] Int. Cl.² ..... C22F 1/08

[58] Field of Search ..... 148/11.5 R, 11.5 C

[56] References Cited

UNITED STATES PATENTS 3,783,037 1/1974 Brook et al. ..... 148/11.5 R

OTHER PUBLICATIONS

Busch et al., *Alloys of Improved Elastic Properties*, Report No. AMRA CR-65-02/1, pp. 1, 13, 14, 43-49, Feb. 1966.

Nagasawa et al., *Memory Effect in Cu-Al Alloy*, Journal Physical Society of Japan, 30(1971)296.

*Primary Examiner*—W. Stallard

*Attorney, Agent, or Firm*—Allegretti, Newitt, Witcoff & McAndrews

[57] ABSTRACT

An improved ternary brass alloy includes silicon as the additive material. The composition limits of the constituents of the brass are fixed by two factors: (1) the $M_s$ or Martensite transformation temperature, and (2) the brass must be a totally beta phase above 454° C. The composition may be betatized, that is, heated at approximately 800° C. and quenched at a fast rate so that the beta phase is retained in order to provide material having a shape memory effect, a low spring back coefficient and super elastic properties. A continuous betatizing and quenching process may be utilized in the manufacture of strip and sheet products. Alternatively, the composition may be hot worked between 600° and 700° C. and then cold worked to provide a material having a low spring back coefficient.

6 Claims, 17 Drawing Figures

Zn
50
847°C
45
40
35
30
25
20
15
10
5
β
β+L
α+β
α
ATOMIC % ZINC
Cu
5
10
15
20
25
Si
ATOMIC % SILICON

Zn
50
760°C
45
40
35
30
25
20
15
10
5
β
γ
γ+χ
β+γ
β+ζ
β+γ+ζ
α+β
α+β+ζ
α+ζ
ζ
β+γ
ATOMIC % ZINC
Cu
5
10
15
20
25
Si
ATOMIC % SILICON (α+β x40

CuZnSi (β-PHASE x40

ENGINEERING STRESS VS. STRAIN CURVE FOR TYPICAL COMMERCIAL MATERIAL

EFFECT OF COLD-ROLLING ON ULTIMATE STRENGTH

EFFECT OF COLD-ROLLING ON YIELD STRENGTH
0.1% OFFSET

FIG. 17.
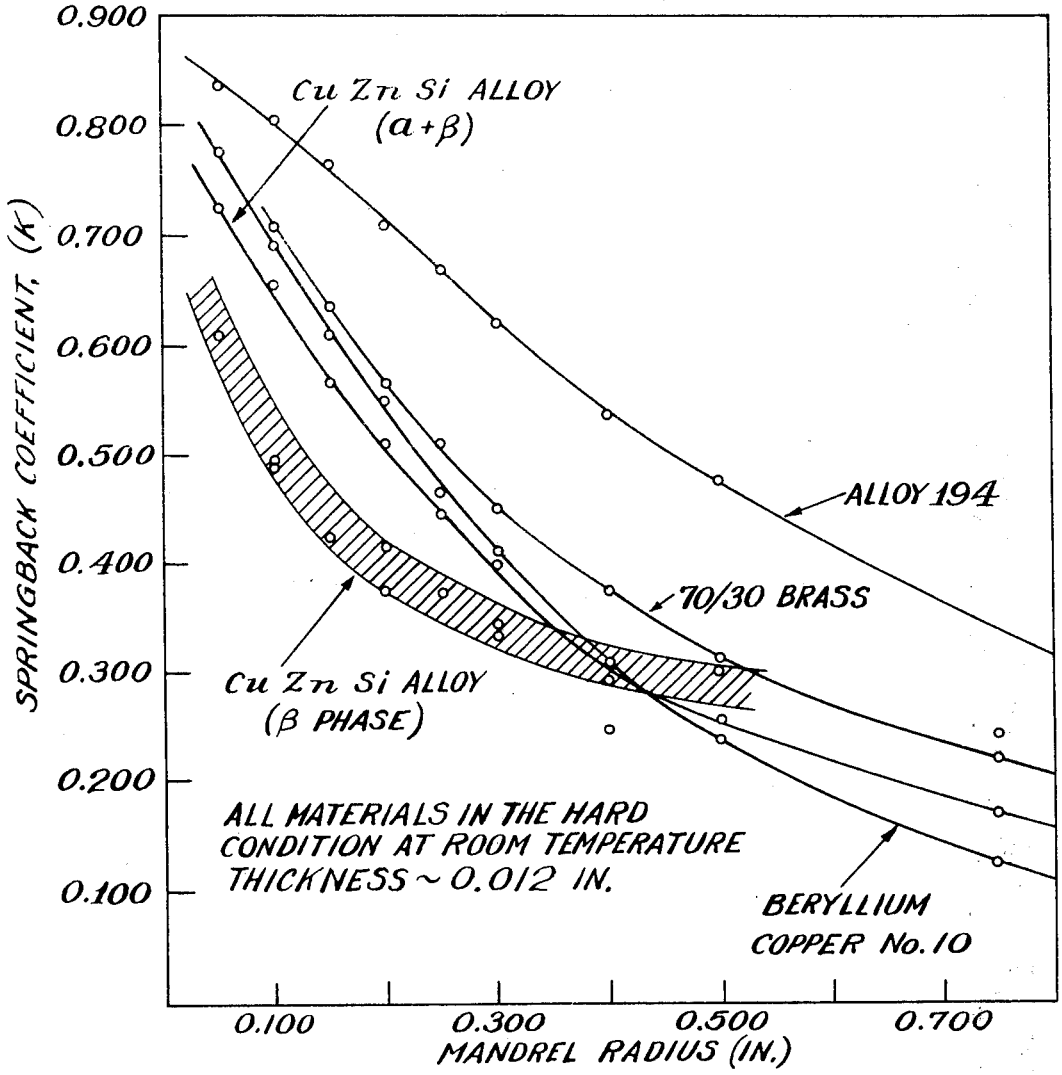
SPRINGBACK COEF. (K) $K = \frac{a_F}{a_0} = \frac{R_0 + h/2}{R_F + h/2} = 0 \text{ TO } 1$
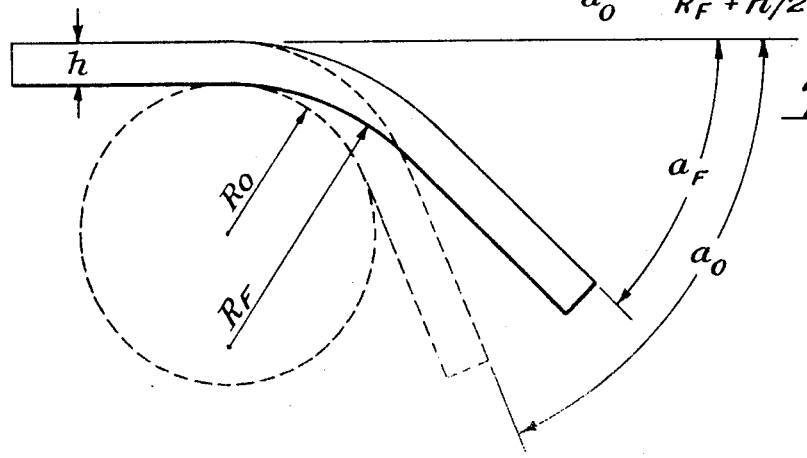
FIG. 16.

WROUGHT BRASS ALLOY HAVING A LOW SPRING BACK COEFFICIENT AND SHAPE MEMORY EFFECT

This is a continuation of application Ser. No. 107,118, filed Jan. 18, 1971, and now abandoned.

BACKGROUND OF THE INVENTION

This invention relates to an improved brass alloy and its fabrication process, and in particular to a ternary brass alloy which may be fabricated into strip, sheet, or wire and which has a low spring back coefficient and a shape memory effect.

Utilization of various alloying elements in a brass (copper-zinc) system has been suggested heretofore for the purpose of obtaining certain desired characteristics in the system. Edmunds in U.S. Pat. No. 2,394,673, for example, suggested the addition of 1.2% silicon to a 70/30 cartridge brass to provide resistance to season cracking. One of the present inventors has investigated numerous ternary beta brass alloys and has reported his findings in the *Transactions of the Metallurgical Society of AIME*, Vol. 230 (1964), Page 267; Vol. 230, Page 1662 (1964); Vol. 236, Page 1532 (1966); Vol. 239, Page 756; Vol. 239, Page 1668 (1967); and *Metallurgical Transactions*, Vol. 1, Page 251 (1970).

These cited references report studies relating to the Martensitic transformations of various ternary brass alloys. A determination was made of the Martensitic transformation temperature as a function of the percentage of the third element content in such alloys. In addition, an investigation of the reaction of such alloys to stresses and temperature changes were reported in these various publications. These publications thus serve as a part of the background upon which a reservoir of knowledge has been developed by the present inventors. Subsequent developmental work to that reported in these various publications has resulted in the development of the presently claimed invention. This subsequent developmental work has resulted in the discovery of a copper-zinc-silicon ternary alloy and its fabrication process, the alloy having an exceptionally low and unexpected spring back coefficient. In addition, the alloy exhibits the so-called "super elastic" behavior as well as the so-called "shape memory effect".

SUMMARY OF THE INVENTION

In a principal aspect then, the present invention comprises an improved ternary brass alloy having a low spring back coefficient and consisting essentially of 0.25% to 3.00% by weight silicon (0.56 to 6.6 atomic %), 25.00% to 40.00% by weight zinc (23.5 to 40.5 atomic %) and the balance copper. The composition comprises a stable beta phase above 454° C. and has a Martensitic transformation temperature defined by the formula $M_s \approx 3280° K - 80Zn° K - 120Si° K$.

The improved ternary brass alloy may be fabricated by either of two methods. In a first method, the constituents of the alloy are combined to provide a substantially homogeneous mixture. The mixture is then betatized (a process which will be defined in greater detail below) and subsequently rapidly quenched to a temperature substantially equal to the temperature of normal expected use of the composition. Continuous betatizing and quenching of strip and sheet has been developed and may be used.

The alternative process for manufacturing such an improved ternary brass alloy calls for cold working a mixture of alpha and beta phase material subsequent to hot working the material in a range of 600° –700° C. The product by each process does, in fact, exhibit low spring back coefficient properties. Moreover, the betatized material exhibits a shape memory effect, particularly below the Martensitic transformation temperature as well as super elastic properties.

It is thus an object of the present invention to provide an improved ternary brass alloy having a low spring back coefficient.

It is a further object of the present invention to provide an improved brass alloy which exhibits a shape memory effect.

A further object of the present invention is to provide an improved brass alloy which is easily fabricated, particularly in the strip, sheet and wire forms. Such an alloy may thus be utilized for the manufacture of springs, particularly for electrical applications.

A further object of the present invention is to provide a ternary brass alloy which exhibits a low spring back coefficient when that alloy is treated by means of appropriate commercial cold working and hot working processes. It is a particular advantage of such a composition that the material maybe fabricated into a desired shape by means of presently available commercial fabrication operations. At the same time, the material maintains a low spring back coefficient, that is, a spring back coefficient which is lower than the coefficient of competitive materials presently available for commercial application, e.g. beryllium copper, phosphor bronze, cartridge brass and Alloy 194.

Still a further object of the present invention is to provide a process for continuously betatizing and quenching materials, particularly strip and sheet.

BRIEF DESCRIPTION OF THE DRAWINGS

In a detailed description which follows, reference will be made to the drawings comprised of the following figures:

FIG. 25 illustrates the effect of cold rolling on elongation characteristics;

FIG. 16 is a schematic illustration used to illustrate the definition of the spring back coefficient; and FIG. 17 is a graphical representation of spring back coefficient for the improved material of the present invention as compared to several prior art materials.

DESCRIPTION OF THE PREFERRED EMBODIMENT

In the description which follows, the improved ternary brass alloy of the present invention will be described in terms of a product derived by means of a process. The unique properties which are the result of the invention require not only a specific composition of materials, but also a unique method of manufacture. Thus, first there will be discussed the requirements for the composition. This will be followed by a discussion of the process used once the composition has been made. Following this, specific examples will be set forth and then a discussion of the numerous advantages and properties of the invention will be provided.

Composition

Figure 2:
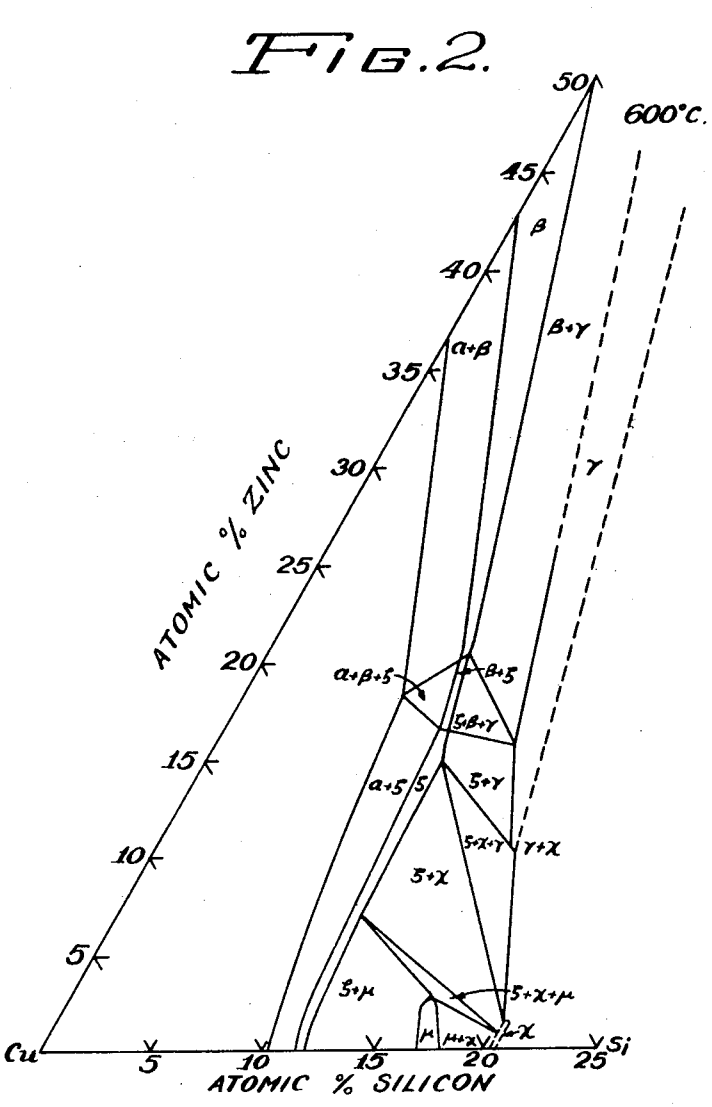
FIG. 2 is a portion of the isothermal section at 600° C. of the copper silicon zine ternary phase diagram.
Figure 1:
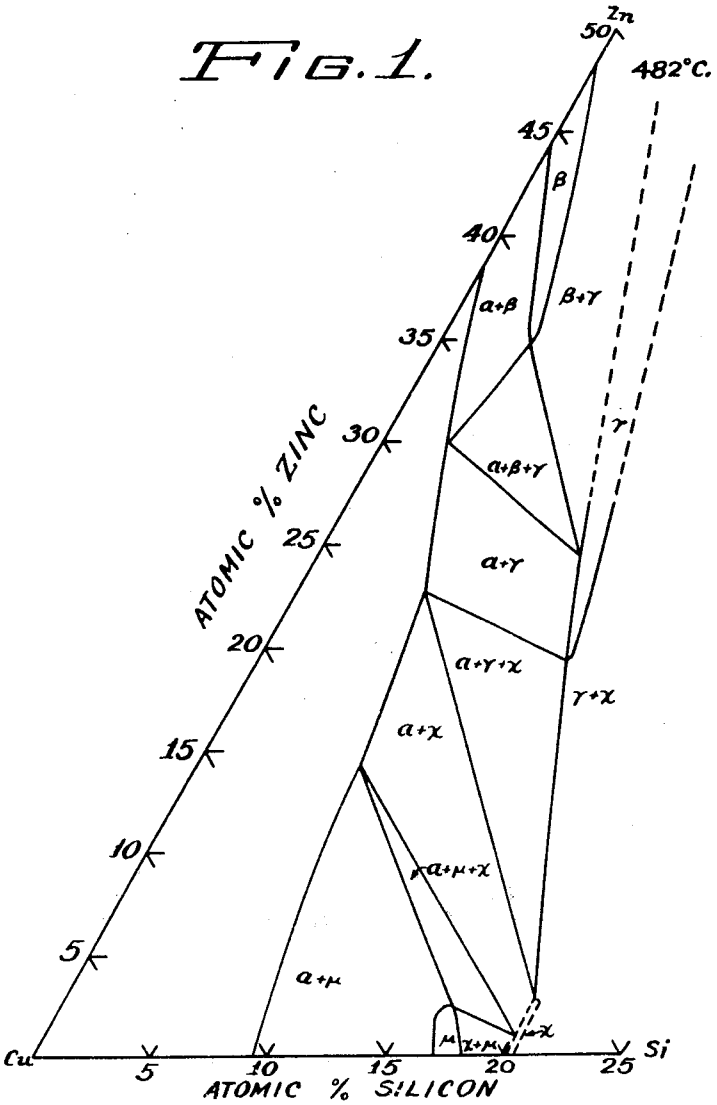
FIG. 1 is a portion of the isothermal section at 482° C. of the copper silicon zinc ternary phase diagram.
Figure 4:
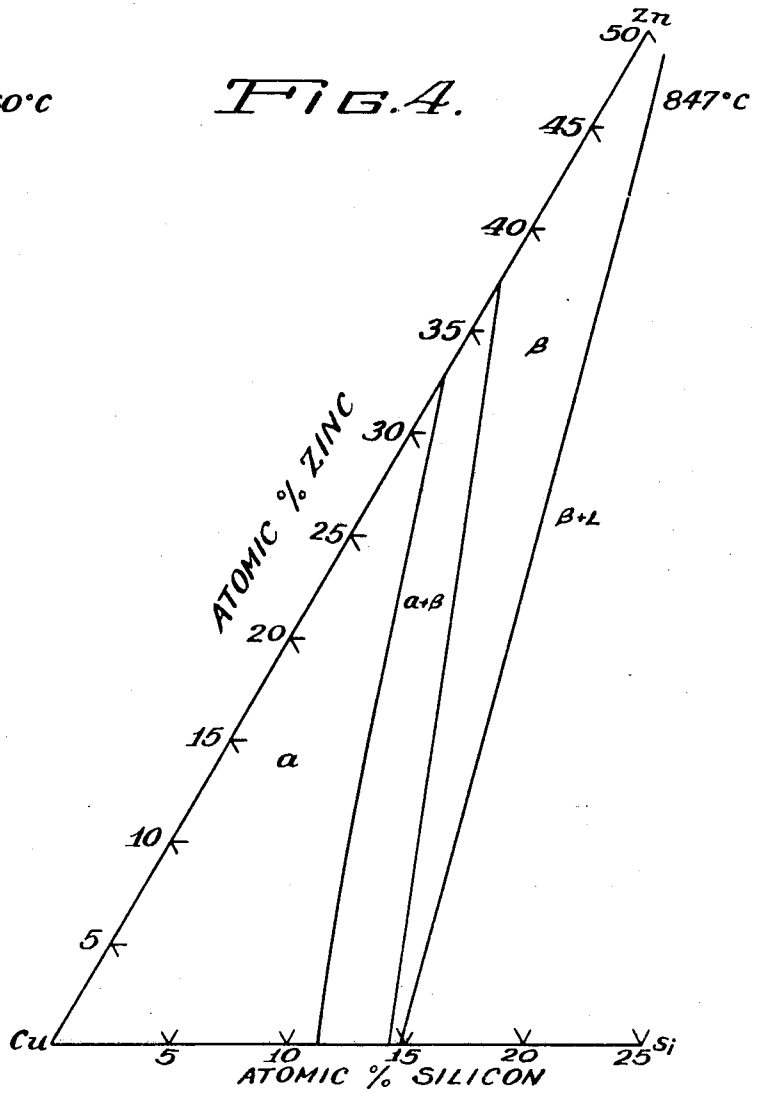
FIG. 4 is a portion of the isothermal section at 847° C. of the copper silicon zinc ternary phase diagram.
Figure 3:
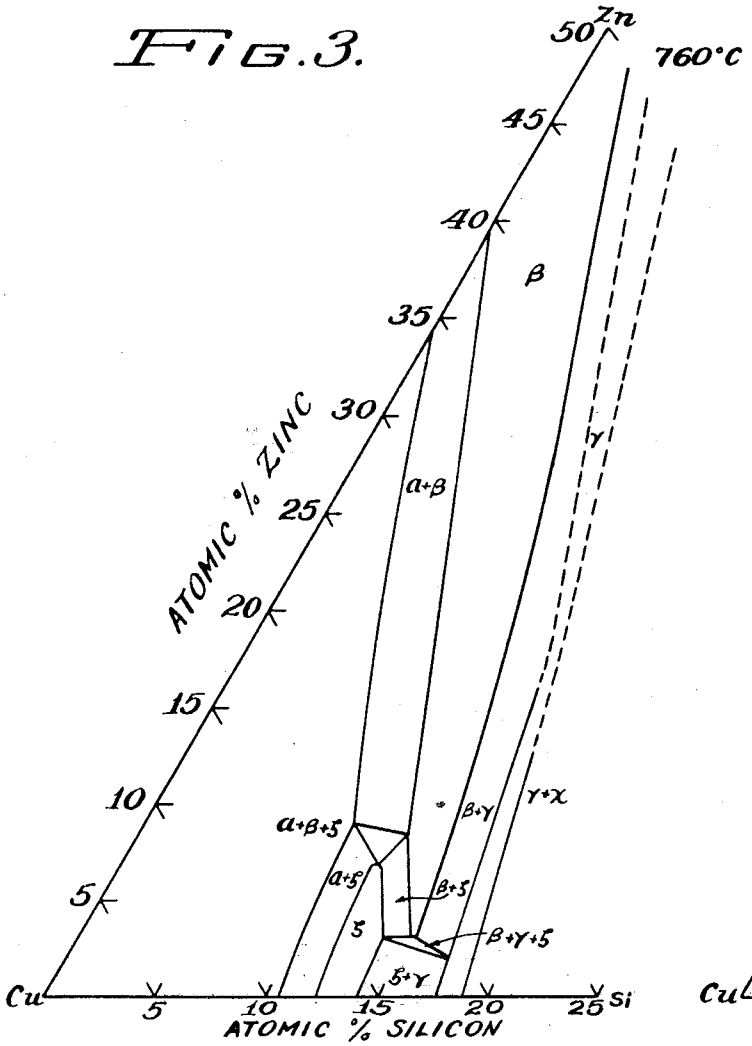
FIG. 3 is a portion of the isothermal section at 760° C. of the copper silicon zine ternary phase diagram.

Copper, zinc and silicon are the materials utilized in the appropriate amounts and fabricated by the appropriate process to provide the alloy of the invention. The composition must provide a beta phase material above 454° C. FIGS. 1 through 4 illustrate four isothermal sections of the ternary phase diagram for the copper-silicon-zinc system. As can be seen by an examination of the ternary phase diagrams, the existence of the beta phase (which is a body-centered cubic phase) is, in part, dependent upon the temperature. That is, whether or not a beta phase can exist at a particular composition depends upon the temperature of the system. For example, much of the experimentation which will be described below relates to a composition which includes 36.5 atomic percent zinc and 1.0 atomic percent silicon. At 847° C. such a composition is in the beta phase as illustrated in FIG. 4. At 760° C., however, as illustrated in FIG. 3, the material is comprised of the alpha plus beta phases. One may provide a composition that will, however, have a beta phase at the desired temperature by choosing amounts of constituent as determined by the isothermal diagrams of FIGS. 1 through 4. To recapitulate, the first important consideration, then, is that the material can be maintained entirely in the beta phase at a desired temperature above 454° C.

The second important criterion relating to composition is determined by the Martensitic transformation termperature. Experimental results reported in the above-noted background literature have shown that the following formulation is qualitatively determinative of the Martensitic transformation temperature of a copper-silicon-zinc alloy:

$$M_s(^\circ K) \approx 3280 - 80Zn - 120Si$$

where

Zn = atomic percent Zinc and

Si = atomic percent silicon.

As will be described below, it has been found desirable to maintain the Martensitic transformation temperature of the alloy of the invention at approximately the same temperature or slightly below the temperature at which the material being fabricated will be used. Most often, this will be room temperature, for example.

Thus, the composition is chosen by examination of two separate criteria:

1. The composition must provide a continuous beta phase material at the same temperature above 454° C. Preferably, the material is a beta phase material when heated above 600° C.
2. The Martensitic transformation temperature of the material is at or below the temperature at which the alloy is intended to be used.

As a result of these two criteria, it has been found that the brass alloy which includes 25.00% to 40.00% by weight zinc (23.5 to 40.5 atomic %) and 0.25% to 3.00% by weight silicon (0.56 to 6.6 atomic %) with the remainder of the alloy being copper will provide the substantial limits of composition which can be processed within the scope of the invention. It should also be noted, however, that some impurities (fillers) may be included in the alloy composition up to an amount of approximately 5% appreciably without affecting the phenomena associated with the invention. However, the criteria that the composition have a continuous beta phase and an appropriate $M_s$ temperature are still effective.

Process

Figure 5:
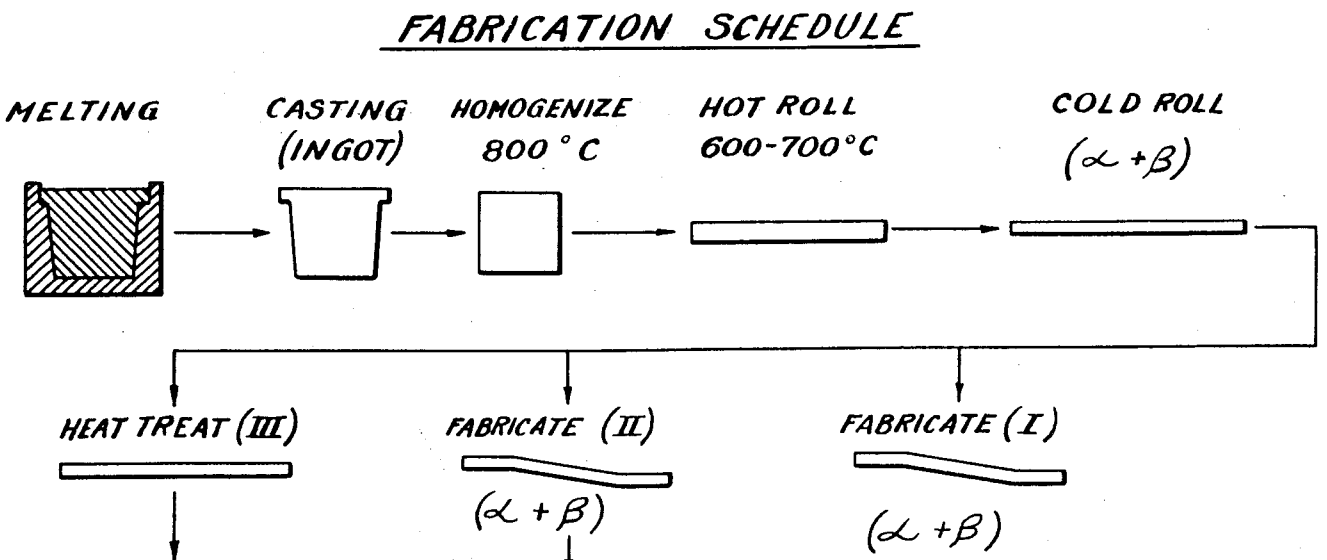
FIG. 5 is a schematic representation of a typical fabrication schedule illustrating the process by which the product of the present invention is manufactured.

FIG. 5 illustrates schematically a fabrication flow chart which outlines the process by which the product of the present invention may be fabricated to provide the unusual and desired characteristics described in detail below. There are generally three processes by which the ultimate desired product may be obtained. Two of these processes call for betatization or betatizing the composition.

Betatizing or betatization is a word which the inventors utilize to describe a distinct step in the process of the present invention. Betatizing or betatization can be defined as the heating or annealing process by which the composition is maintained at an appropriate temperature above 454° C. until all of the composition is changed into the beta phase. The term is analogous to austentization which is well known for steels. As with austentization in steel, a time temperature transformation (TTT) diagram can be provided for the alloy of the present invention. In the specific examples below, it can be seen that time temperature transformation relationships for the specific examples are indicated.

As shown in FIG. 5, the first step for each of the three processes calls for combining the constituents of the alloy, melting them together and casting them into an ingot. The casting may then be homogenized at approximately 800° C. Homogenization can take place at a lower temperature, for example, 700° C. when the alloy may be in the $\alpha+\beta$ phase. Next, the casting may be hot rolled at between 600° to 800° C. The amount of reduction by hot rolling is as desired. Cold rolling then follows with optional intermediate anneals at 525° C., for example, for a period of one-half hour. The annealing operation serves to recrystalize the alloy and thus other annealing temperatures are suitable, for example, any temperature in the range of 300° to 700° C. It is possible to cold roll and reduce the thickness of the sheet by as much as 70% to 95% without loss to the integrity of the material and without intermediate anneals.

It is now possible to merely fabricate the material into a desired sheet or rod product. This is illustrated by the symbology in FIG. 5 designated by I. The material in this case is composed of the alpha (face-centered cubic) and beta phases and the material may be utilized in this form and will incorporate the advantages of the invention. In case I, it is important to note that the cold rolling operation must follow a hot rolling operation. This sequence of operation provides some of the specific properties desired and found in the present invention.

Alternatively, the processes illustrated by II and III may be followed. In each instance (II and III) the specific heat treatment utilized to create the desired material is the same. However, in II the material is first fabricated into a desired shape, for example, a leaf spring, before heat treating. In III the heat treatment is initially provided and then the material is fabricated into its ultimate desired product shape.

Returning then to the material of II, the material is initially in the alpha plus beta phase since it is derived as described for I. This material is fabricated into the desired shape and then betatized. Typically, the betatization must take place at more than 790° C. However, betatization does depend upon the composition of the material and the appropriate temperature may be determined by examination of the ternary phase diagram. Following betatization, the material is rapidly quenched at a rate preferably greater than 500° C. per second. The rapid quenching is necessary in order to retain the beta phase since it is this phase which is associated with the unique characteristics of the present invention.

The process represented by III calls for betatization followed by rapid quenching as described for II. This in turn is followed by fabrication of the ultimate desired product, e.g. a spring. It has been found, in fact, that fabrication following betatization and quenching (process III) enhances the properties of the material.

Figure 6:
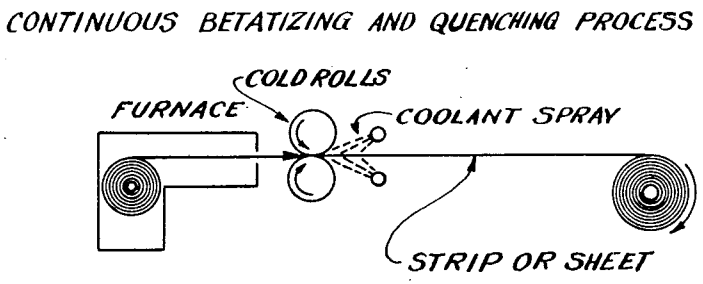
FIG. 6 is a schematic representation of means for providing the betatizing and quenching operation of the present invention.

FIG. 6 illustrates a means for the continuous betatization heat treatment and the rapid quenching required in the association with the betatization process of strip or sheet. The material is initially rolled into strip or sheet form and heated to its proper betatization temperature in a furnace. The material is then unrolled or discharged from the furnace and immediately quenched by cold rolls and a coolant spray. This quench must be fast enough to prevent decomposition of the beta phase into any other phase. The beta phase is retained. The heat treated metal is then wound on a roll as indicated in FIG. 6.

Typically, using the arrangement of FIG. 6, the betatizing treatment for strip or sheet on an economical continuous basis (high processing rate is feasible) is achieved by providing slight tension (normal practice in strip or sheet finishing), and the proper roll pressure on the hot material as it passes through the heat extraction means (cold rolls and coolant spray). The roll pressure is adjusted to provide efficient heat transfer from the strip or sheet surfaces to the roll surfaces. The speed of the rolls, the coolant temperature and flow rate, and the takeup tension are then adjusted to provide the rapid quench of more than 500° C. per second to prevent decomposition of the beta phase and to yield flat, high quality strip or sheet.

EXAMPLES

Example 1

A high purity or commercial copper in the amount of 62.19 weight percent (62.5 atomic percent) is combined with 37.37 weight percent (36.5 atomic percent) similar grade zinc and 0.44 plus or minus 0.10 weight percent silicon (1.0 atomic percent silicon). The constituents are thoroughly combined in a crucible, melted together and cast as an ingot. The resulting casting is then homogenized at approximately 800° C. The homogenized ingot is hot rolled at a temperature between 600° and 700° C. and reduced to a suitable plate thickness. Following this, the material is cold rolled up to 80% reduction. As an aside, it should be noted that intermediate anneals at 525° for one-half hour may be provided. However, it is important that the final operation in the process be a cold rolling operation. Such cold rolling enhances the desired physical properties of the material which has been fabricated. This material may then be fabricated into a leaf spring, for example, the properties of which will be described in detail below.

Example 2

The identical procedure to that set forth in Example 1 above is followed. However, subsequent to the cold rolling operation, the material is heat treated for one minute at 830° C. The material is then quenched at a rate greater than 500° per second and fabricated as desired. Alternatively, the material is fabricated and then heat treated at 830° C. and quenched at more than 500° C. per second as described. In each instance, the fabricated product may be a leaf spring of the type for example described in Example 1.

In Example 1, the material was a mixture of alpha phase and beta phases. The alpha phase constitutes approximately 60% of the material with the beta phase comprising the remaining 40%. It is possible, however, depending upon the composition and the Martensite transformation temperature to provide for an alpha phase having 50% plus or minus 20% alpha phase and 50% minus or plus 20% beta phase. In any event, the properties described below will still appear providing the appropriate final cold working operation has been performed following initial hot rolling.

Figure 7:
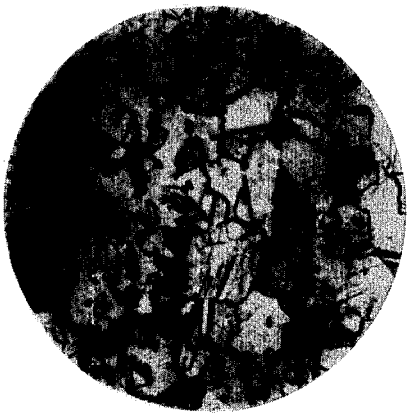
FIG. 7 is a micro photograph illustrating the grain size and structure of the alpha plus beta phases of the copper silicon zinc composition of the present invention taken at 40 magnifications.
Figure 8:
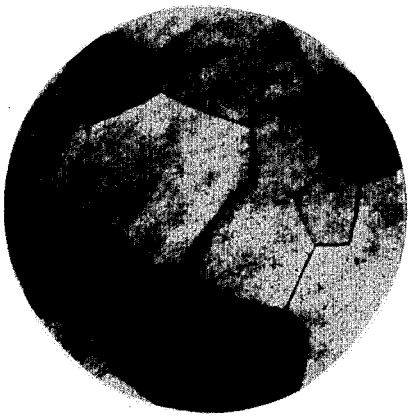
FIG. 8 is a micro photograph of the copper silicon zinc beta phase of the present invention taken at 40 magnifications.

FIGS. 7 and 8 respectively are micro photographs of the alpha plus beta of Example 1 and the beta phase material of Example 2. As seen by examination of FIG. 7, the alpha plus beta material has a fine grain size, whereas the pure beta phase material has a large grain size. In the following discussion, both the alpha plus beta and the beta phase materials will be discussed in regard to various physical properties. Also, it should be noted that the beta phase alloy will exhibit the super elastic, shape-memory and spring back properties discussed below even though small amounts of the alpha phase may be contained in the beta phase.

Properties

FIGS. 9 through 17 illustrate the properties observed in the alloys of the present invention as compared to the properties observed in typical prior art materials utilized for substantially the same purposes.

Figure 9:
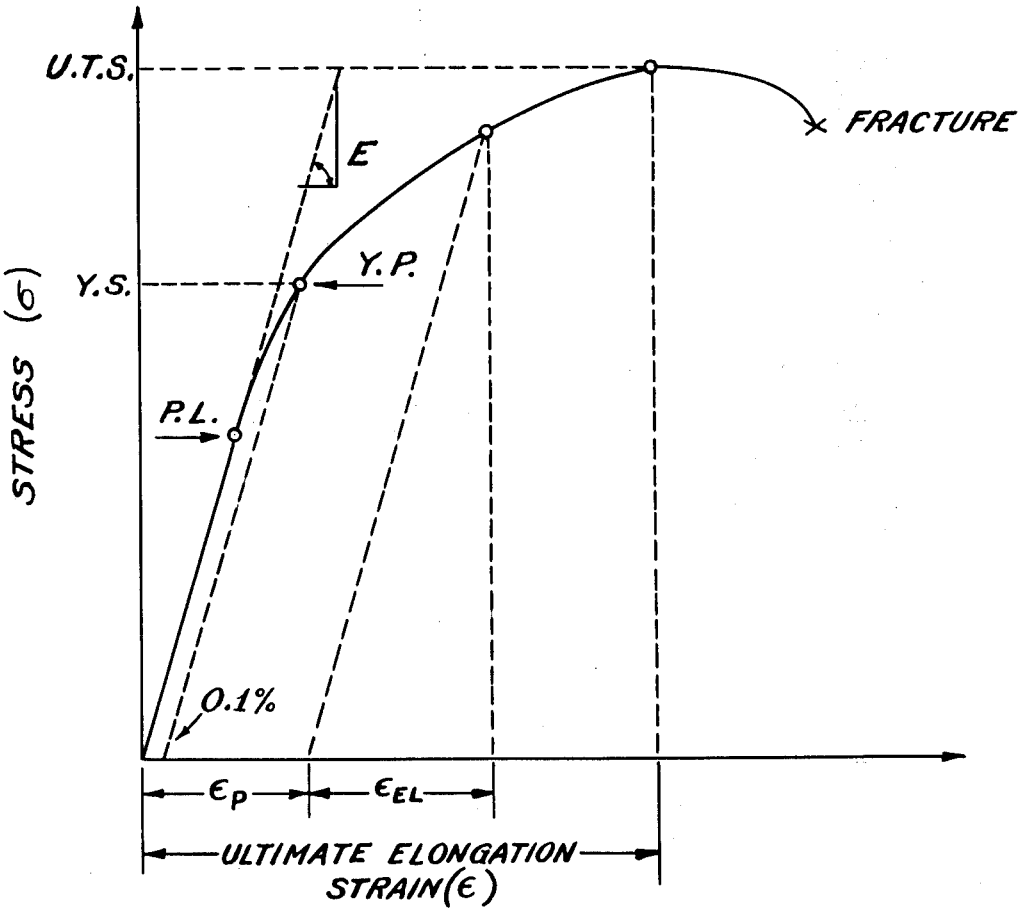
FIG. 9 is a typical engineering stress versus strain curve.

Referring first to FIG. 9, there is shown a typical engineering stress versus strain curve for a commercial material. The stress ($\sigma$) is on the ordinate and strain ($\epsilon$) is on the abcissa. The letters P.L. indicate the proportional limit, that is, the point on the stress-strain curve at which stress is no longer linearly proportional with strain. The yield point is that point where the strain is offset from the linear portion of the stress-strain cruve by an amount equal to 0.1%. The stress at this point is defined as the yield stress, Y.S. The ultimate tensile stress, U.T.S., is the maximum stress which the material may be subjected to prior to fracture and is correlated with the ultimate elongation.

Figure 10:
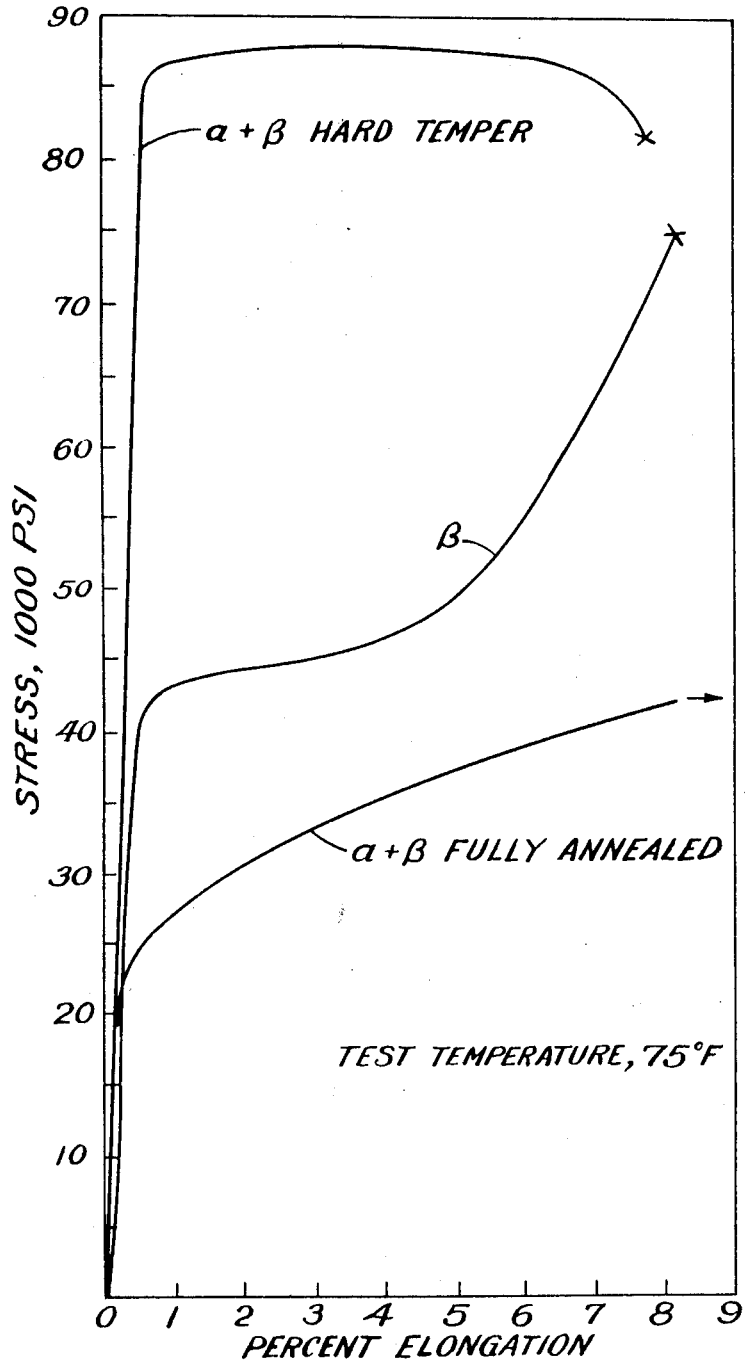
FIG. 10 is a stress versus strain curve for two samples of material incorporating the features of the present invention.

Utilizing these definitions, FIG. 10 shows a typical stress-strain curve for the improved materials of the present invention. As indicated on FIG. 10, the material identified as alpha plus beta ($\alpha+\beta$) was fabricated as set forth in Example 1 above. The material tested for FIG. 10 was cold rolled with a 60% reduction in thickness. The material indicated by beta ($\beta$) was betatized and quenched as set forth in Example 2 using the process schematically described in FIG. 6.

Figure 11:
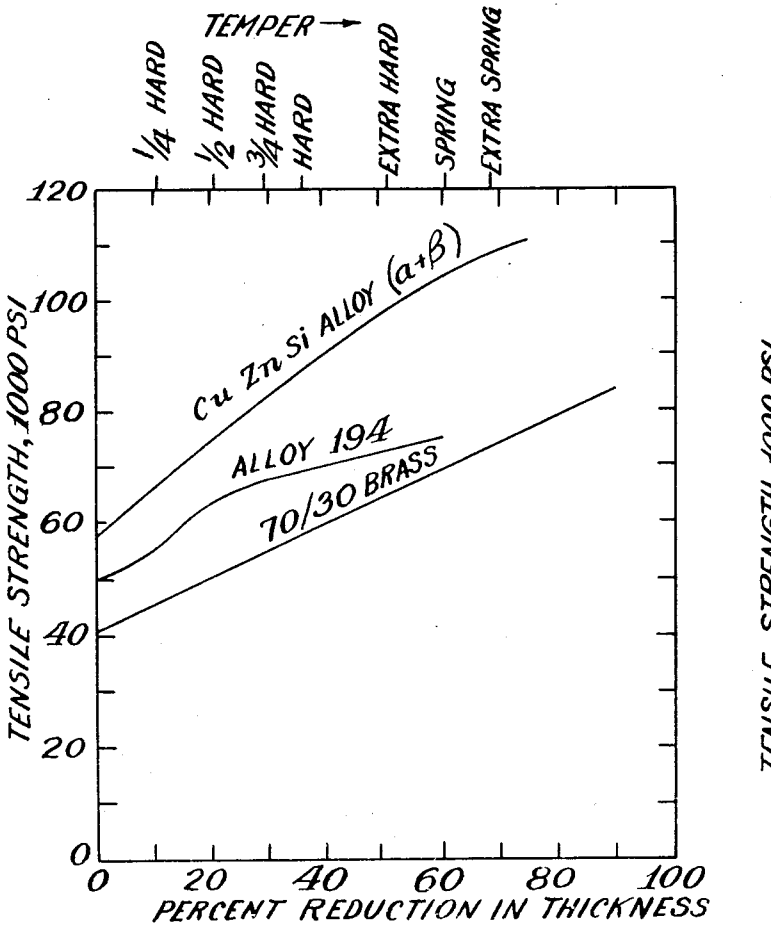
FIG. 11 is a graph representing a typical improved alloy of the present invention in comparison with other prior art material and plots the effect of cold rolling on the ultimate strength of said materials.

FIG. 11 illustrates the effect of increased reduction in thickness during cold rolling on the ultimate tensile strength (U.T.S.) for material of the type set forth in Example 1 above as compared with such prior art materials as 70/30 brass and 98% copper, 2% iron, 0.02% phosphorous, an alloy commonly used for electrical applications as spring applications and known as Alloy 194. Note the increase in the ultimate tensile strength of the alloy of the present invention.

Figure 12:
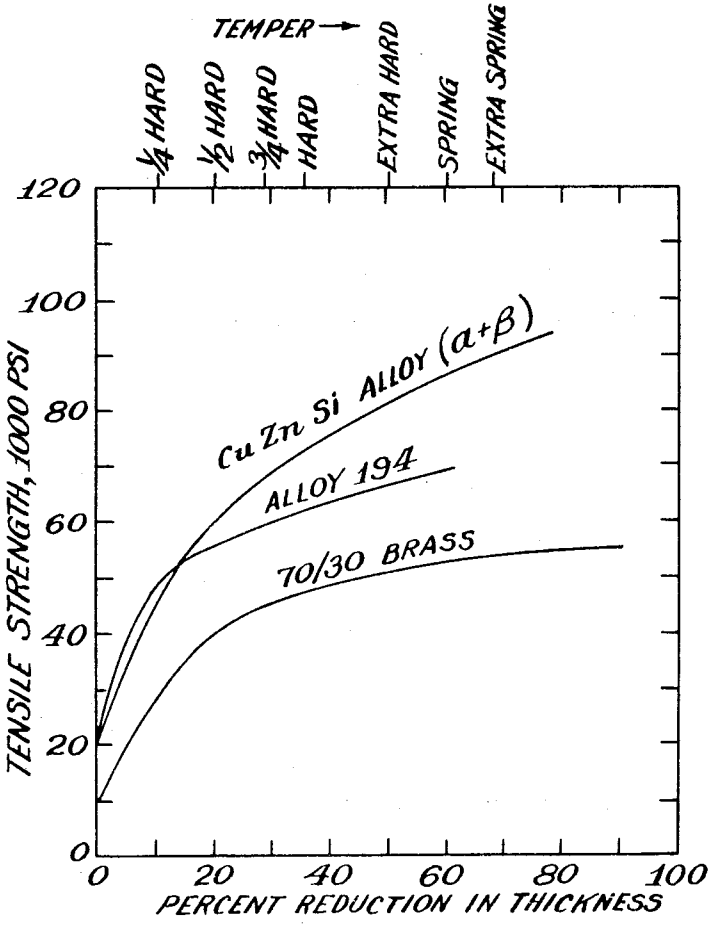
FIG. 12 illustrates the effect of cold rolling on yield stress.

FIG. 12 illustrates the marked increased in the yield strength of the $\alpha+\beta$ form of alloy made in accordance with the present invention in comparison with 70/30 brass and Alloy 194.

Figure 14:
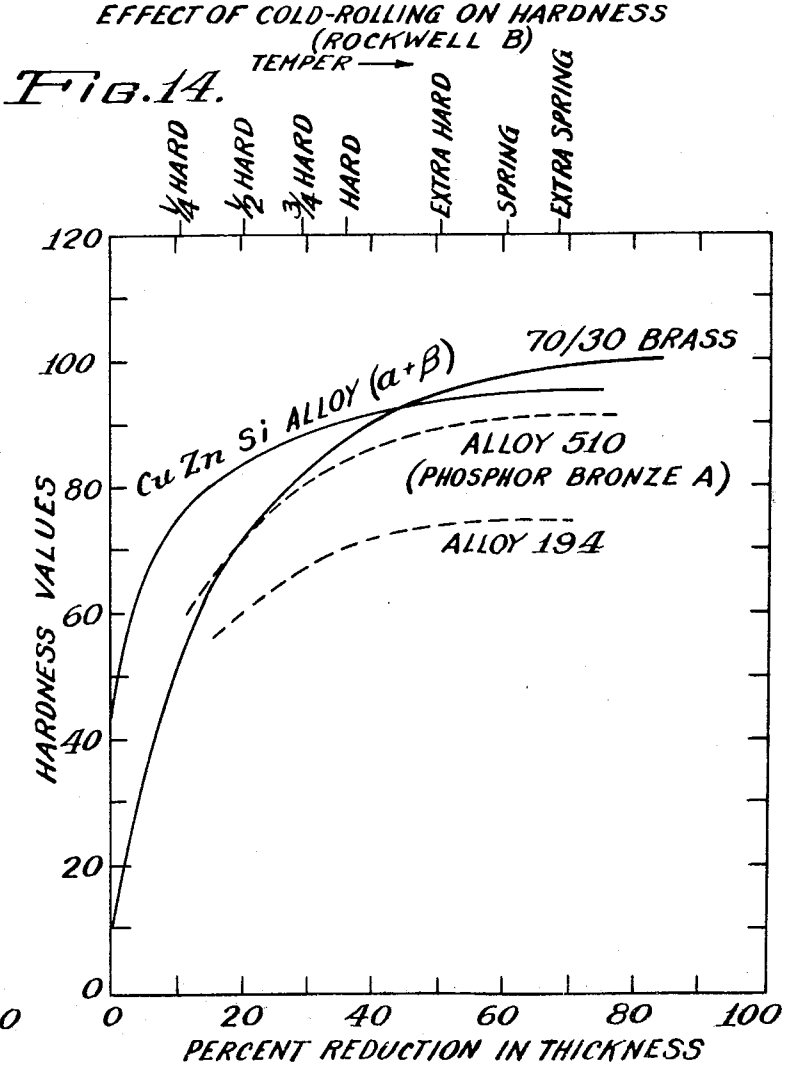
FIG. 14 illustrates the effect of cold rolling on the hardness.
Figure 13:
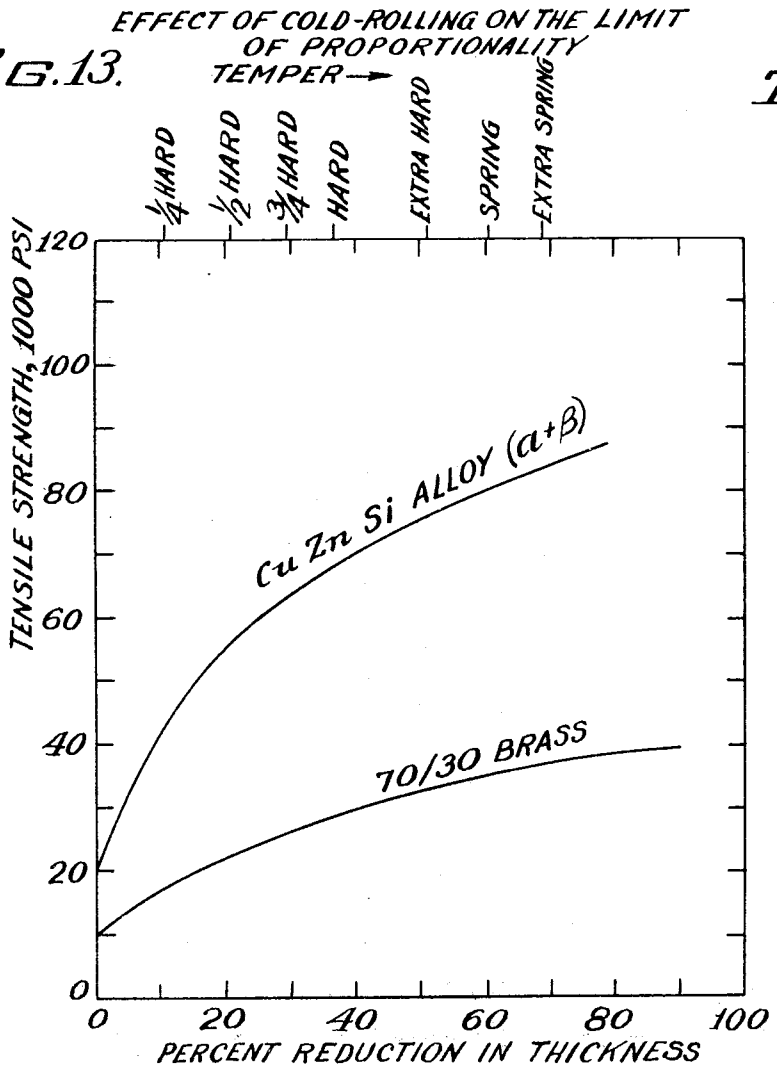
FIG. 13 illustrates the effect of cold rolling on the limit of proportionality.

FIG. 13 illustrates the effect of cold rolling on the limit of proportionality. That is, the material with a higher tensile strength as it is reduced in thickness by greater and greater amounts has a greater proportional limit than a material with a lower tensile strength. It can be seen that the alpha plus beta ($\alpha+\beta$) alloy of the present invention exhibits a dramatic increase in the limit or proportionality over 70/30 brass. FIG. 14 illustrates the effect of cold rolling on hardness. It is desirable that the cold rolling make the material harder, however, not so hard that it would tend to become brittle. As can be seen by the diagram of FIG. 14, the ($\alpha+\beta$) alloy of the present invention compares quite favorably with the prior art alloys used for similar purposes.

Figure 15:
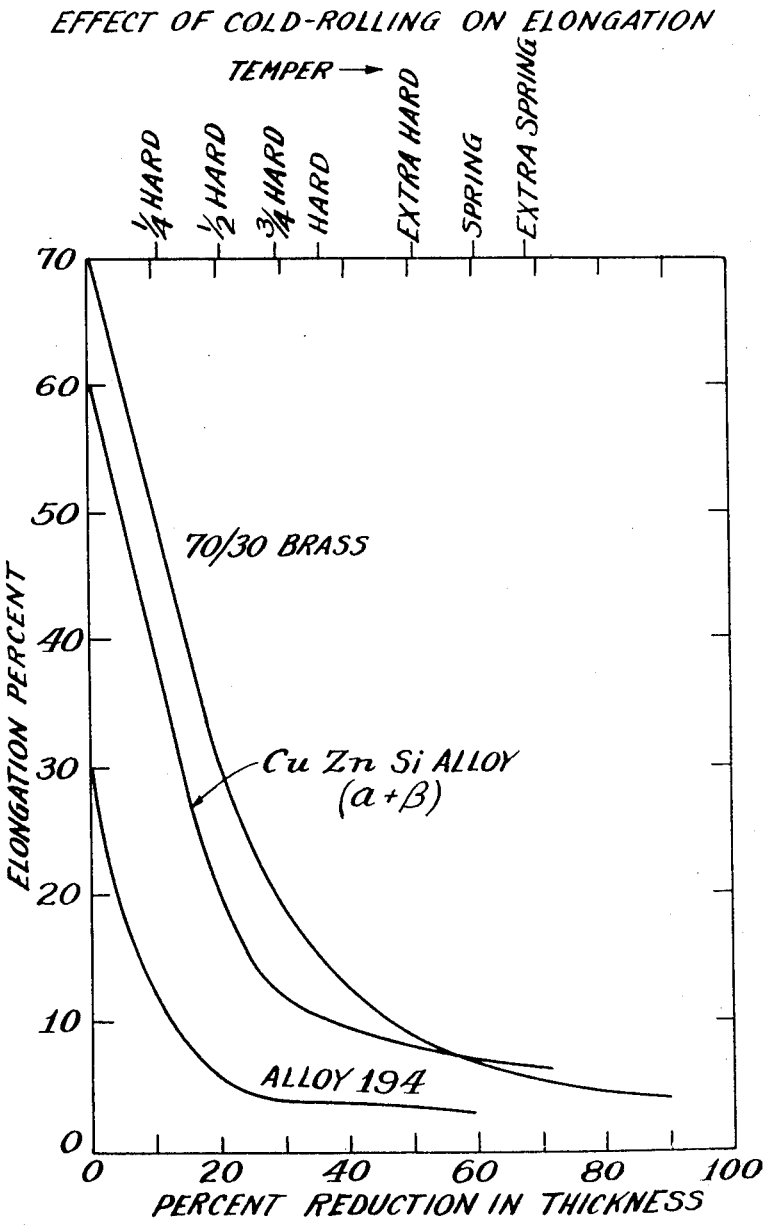

FIG. 15 illustrates the relationship between the amount of elongation which a material will exhibit or permit as a function of the amount of reduction in thickness of the material by cold rolling. In the range where the various materials are most useful, namely, when the temper is designated as spring or extra spring, the alloy of the invention exhibits elongation characteristics which are at least equal or superior to the prior art materials.

Besides the advantages illustrated and discussed above, perhaps the most important advantage realized by the present invention is the improved or low spring back coefficient exhibited by the material. The spring back coefficient is somewhat related to the phenomena known as super elasticity, sometimes observed in various alloys. Super elasticity implies that a material will react in an elastic and sometimes nonlinear fashion over a very long range of strains of that material. Generally, super elasticity is associated with cast materials or hot worked ingots as contrasted with strip, sheet, wire or other wrought materials. That is, it has been found that many materials which are super elastic cannot be easily made into sheet materials by means of cold rolling or other such similar forming operations. In fact, the inventors known of no sheet formed super elastic material prior to the present invention. Thus, although the super elasticity phenomena is observed in a cast material, the advantages of that super elastic phenomena cannot be carried over into the rolled material since the rolled material will tend to crack or otherwise become unuseful.

It is thus desirable to provide a material which can be sheet formed and which will exhibit characteristics analogous to those observed in cast super elastic materials. Such a sheet material can also be defined as one having a low spring back coefficient. While heretofore there has been no material which was super elastic and which also could be formed into a sheet material and thus have a low spring back coefficient, the material of the present invention has such unique properties. That is, the material of the present invention can be rolled into plate and ultimately into sheet or drawn into thin rod or wire and will exhibit not only super elastic properties, but will exhibit an extremely low spring back coefficient. Since it has been impossible heretofore to form super elastic materials into a sheet or a drawn condition, it is remarkable that the present invention provides a material and the process by which such material can be formed and which when it is formed exhibits properties even more desirable than simple super elastic properties.

As mentioned above, the means for comparing elastic properties of sheet or wire materials is known as the spring back coefficient. FIG. 16 illustrates the definition of this coefficient, K. Materials having a low spring back coefficient have the ability upon bending of returning substantially to their original condition. Thus, a material which is perfectly elastic and can return completely to its initial position will have a spring back coefficient of 0. A material which will not return to its new position, but will remain at a position to which it is bent, will have a spring back coefficient of 1. Lead is a typical example of a material having a spring back coefficient of 1.

The coefficient, K, is mathematically defined as the ratio of the original angular deflection of a sheet of material from the horizontal compared with the final angle of deflection once the force imparting the deflection has been removed. For example, if the original deflection imparted over a mandrel having a radius of $R_0$ is equal to 90° and the final $\alpha_f$ is 45° after the material is released, then the spring back coefficient is 0.5.

Referring now to FIG. 17, there is shown a diagram wherein the spring back coefficient is plotted against the radius of a mandrel about which the spring or formed sheet is bent. As can be seen by examining the graph, the material of the present invention has a drastically improved spring back coefficient. As illustrated in FIG. 17, the spring back coefficient for the $\beta$ and $\alpha+\beta$ materials of the present invention is significantly lower than competitive type materials utilized for the same purposes.

Another phenomenum observed in the present invention is often termed the "shape memory effect". That is, the alloy of the invention may be deformed at a temperature below the Martensite transformation temperature. Upon heating the alloy above the Martensite transformation temperature, the deformed alloy material will almost resume its original configuration. This has been found particularly true for the beta ($\beta$) embodiment described above. Moreover, if you again cool the material below the transformation temperature, but render no stress, the material will deform to nearly the same shape as the original deformed material. Upon reheating, the material again returns to its original undeformed shape. Such cycling may be continued.

Other advantages exhibited by the alloys of the present invention include the good machinability, easy tinning and solderability and improved fatigue resistance in comparison with prior art spring materials.

Finally, as set forth below in Table A, there is an indication of the electrical conductivity at 68° F. exhibited by the alloy of the present invention as compared with typical competitive alloys. The conductivity is well within the range of being acceptable, thus indicating utility of the invention for various electrical contactors, etc.

TABLE A

| ELECTRICAL CONDUCTIVITY % IACS AT 68° F | |
|---|---|
| CuZnSi Alloy ($\beta$) ≈ 23% | |
| CuZnSi Alloy ($\alpha + \beta$) ≈ 22% | before heat treatment 25% |
| Beryllium Copper 10 | after heat treatment 50% |
| 70/30 Brass ≈ 28% | |
| Alloy 194 ≈ 60% | |

What is claimed is:

1. An improved method of manufacture for a wrought, polycrystalline brass alloy having a shape memory characteristic and a low spring back coefficient comprising the steps of providing a mixture of constituents consisting essentially of about 0.56 to 6.6, atomic % silicon, 23.5 to 40.5, atomic % zinc and the balance copper, combining said constituents in a substantially homogeneous alloy composition to provide an alloy having a stable beta phase above 454° C. and having a Martensite transformation temperature defined approximately by the formula $M_s$(° K) +3280−80Zn−120Si where $M_s$(° K) is the Martensite transformation temperature in ° K, Zn is atomic percent zinc, and Si is atomic percent silicon, and where the Martensite transformation temperature is substantially at or below the temperature of normal use of said alloy, fabrication of said alloy by working said alloy to insure a polycrystalline structure, heating to effect betatizing wherein essentially all of said alloy is in the beta phase and subsequently quenching said alloy to a temperature at or below the temperature of normal use of said alloy to retain beta phase in said alloy.

2. The process of claim 1 including the additional step of working said alloy after quenching.

3. The process of claim 1 wherein said quench is at a rate of more than 500° C. per second to prevent substantially all decomposition of the beta phase.

4. The process of claim 1 wherein the step of working said alloy includes the step of fabricating said alloy into a manufactured component shape prior to betatizing.

5. The process of claim 1 including the step of working said alloy below the Martensite transformation temperature subsequent to quenching.

6. The process of claim 5 including the step of heating said alloy subsequent to working below said Martensite temperature.

* * * * *